US008033641B2

(12) United States Patent
Hilmersson

(10) Patent No.: US 8,033,641 B2
(45) Date of Patent: Oct. 11, 2011

(54) METHOD AND A DEVICE FOR MOVING A JET MEMBER

(75) Inventor: Ronnie Hilmersson, Holsbybrunn (SE)

(73) Assignee: Aquajet Systems Holding AB, Holsbybrunn (SE)

( * ) Notice: Subject to any disclaimer, the term of this patent is extended or adjusted under 35 U.S.C. 154(b) by 1035 days.

(21) Appl. No.: 11/794,713

(22) PCT Filed: Jan. 5, 2005

(86) PCT No.: PCT/SE2005/000006

§ 371 (c)(1),
(2), (4) Date: Jul. 3, 2007

(87) PCT Pub. No.: WO2006/073337

PCT Pub. Date: Jul. 13, 2006

(65) Prior Publication Data

US 2009/0207207 A1 Aug. 20, 2009

(51) Int. Cl.
*B41J 23/00* (2006.01)

(52) U.S. Cl. ..... 347/37; 404/91

(58) Field of Classification Search ..... 347/37; 404/79, 91

See application file for complete search history.

(56) References Cited

U.S. PATENT DOCUMENTS

| | | | | |
|---|---|---|---|---|
| 4,784,518 | A * | 11/1988 | Cutler | 404/79 |
| 5,361,993 | A * | 11/1994 | Andersson | 239/752 |
| 6,179,519 | B1 * | 1/2001 | Hilmersson | 404/91 |

FOREIGN PATENT DOCUMENTS

| | | |
|---|---|---|
| EP | 0544775 | 6/1993 |
| EP | 1029127 | 8/2000 |
| SE | 524045 | 7/2002 |

* cited by examiner

*Primary Examiner* — Charlie Peng
*Assistant Examiner* — Peter Radkowski
(74) *Attorney, Agent, or Firm* — Dilworth & Barrese, LLP

(57) ABSTRACT

A device for moving a jet member (6) having a nozzle has a carriage (4) movable in a substantially rectilinear path and provided with a base portion to which the jet member is pivotably connected. A first drive member (9) is arranged for moving the carriage for moving the nozzle of the jet member in the rectilinear path over a layer to be treated by the jet, and a second drive member (10) is arranged for pivoting the jet member with respect to the base portion for changing the attack angle of the jet upon the layer. A control arrangement (21) is situated to coordinate the control of the first and second drive members for moving the impact point of the jet on the layer with a substantially constant speed over the layer.

18 Claims, 3 Drawing Sheets

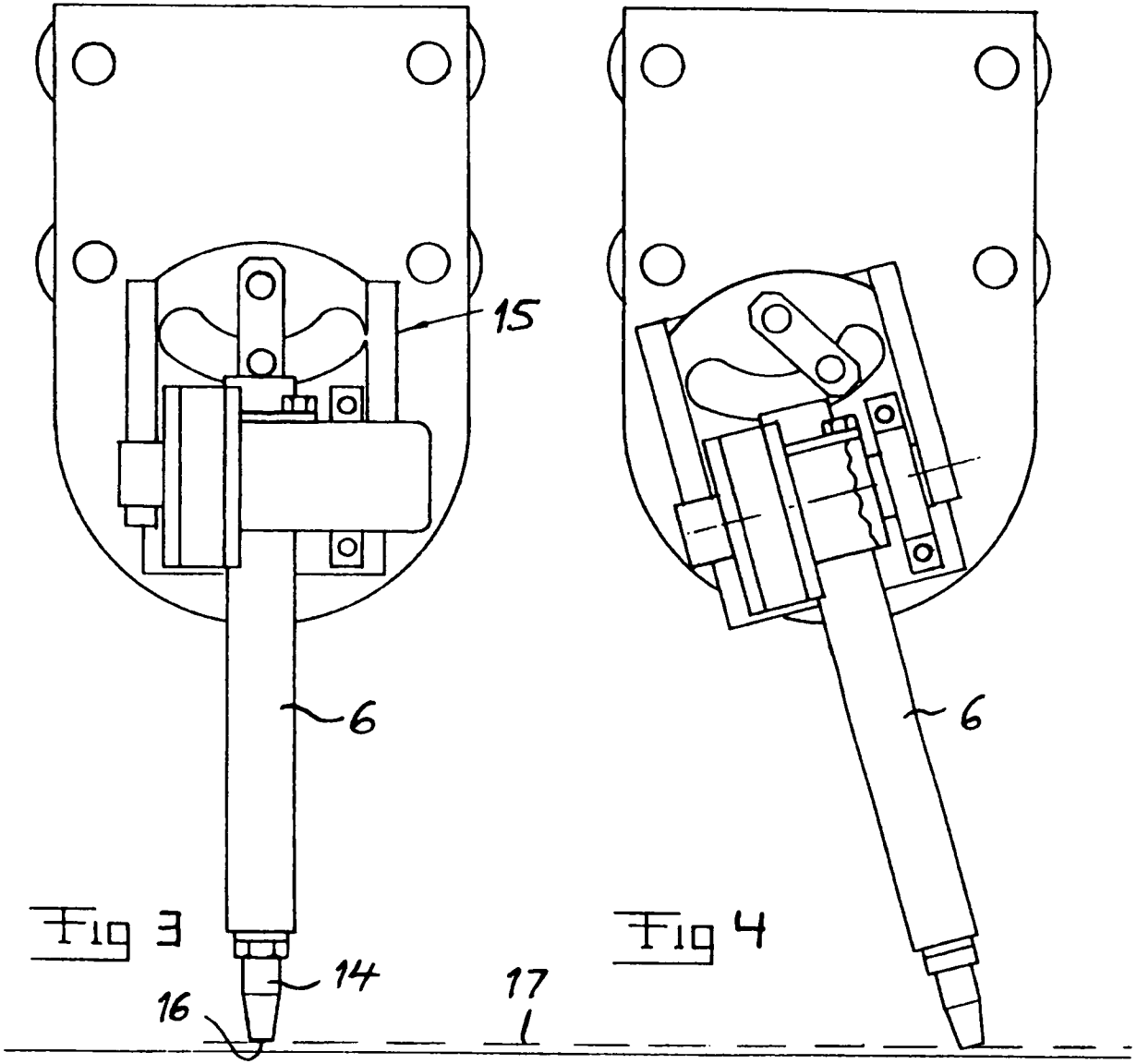
Fig 4
Fig 3
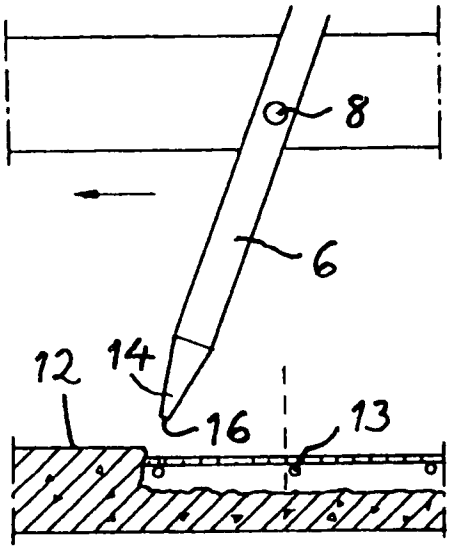
Fig 2

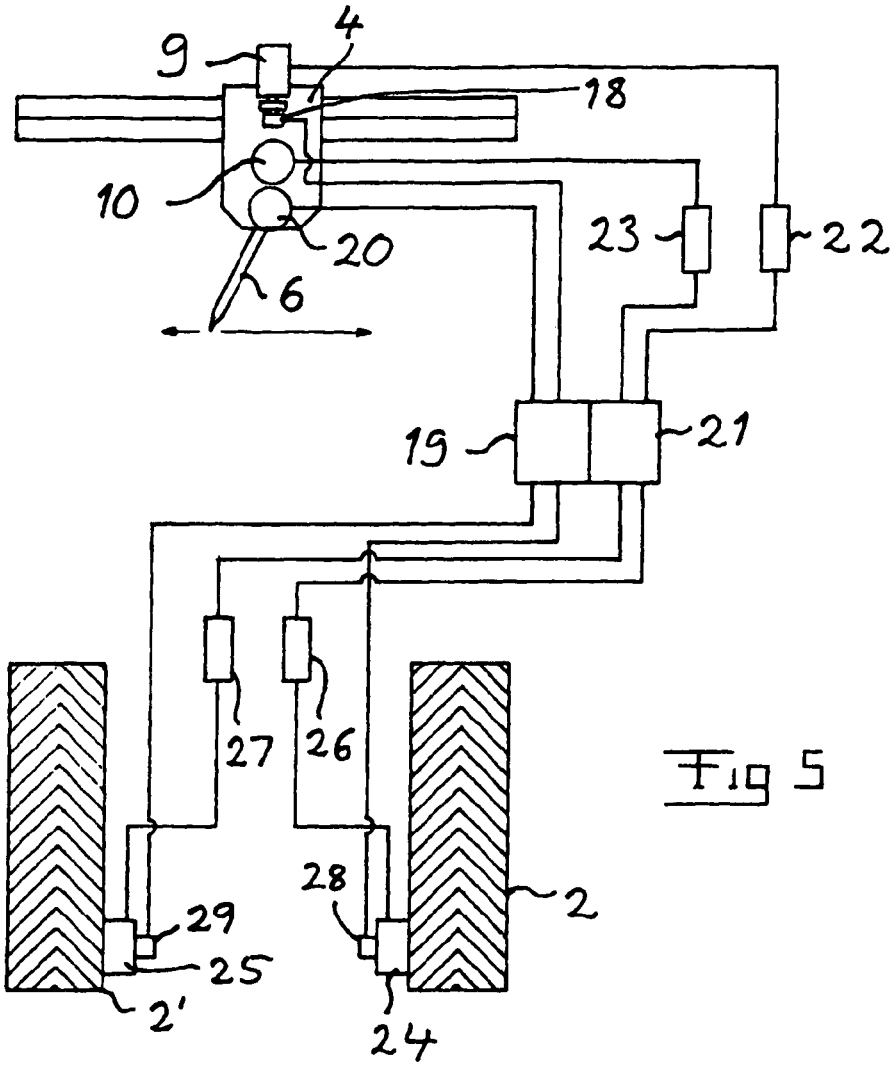
Fig 5
Fig 6
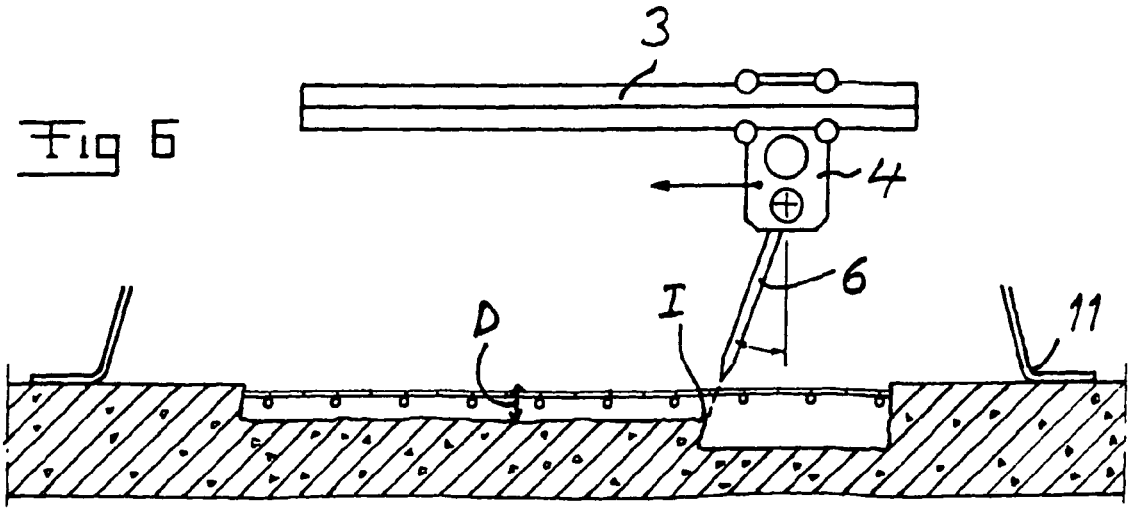

METHOD AND A DEVICE FOR MOVING A JET MEMBER

BACKGROUND OF THE INVENTION

Technical Field of the Invention and Prior Art

The present invention relates to a method and a device for moving a jet member having a nozzle according to the preambles of the appended independent method and device claims.

This treatment of a material layer is first of all intended to be a material removing treatment. Although the layer may consist of other material a concrete layer is preferably concerned herein. Primarily, the treatment is intended to have the purpose to remove weakened material from the layer. It may then be a question of removing weakened concrete from concrete layers on roads, bridges and a variety of building structures, whereupon the removed concrete may be replaced by new concrete. It is in this connection especially preferred that the treating member is constituted by a jet member so as to direct a high pressure jet of liquid against the material layer. Thus, it is this high pressure jet of liquid which executes the material removing treatment. Preferably, the high pressure liquid consists of water.

One of the main reasons for pivoting said jet member for changing the attack angle is due to the fact that said concrete layers are reinforced by reinforcement bars, normally in a lattice-like structure. By using a small attack angle, i.e. an angle of the jet being substantially perpendicular to the layer to be treated, the material may be removed quickly, but the result of the treatment will not be that uniform. However, by choosing a large attack angle of the jet the jet will easier reach under the reinforcement bars, so that it will be cleaner thereunder and the result of the treatment will be more uniform and the surface treated smooth.

The pivoting of said jet member is normally carried out in the turning zones of said carriage, i.e. in the end and the beginning of said rectilinear path of the carriage close to the respective end position of that path, i.e. the turn point of the carriage, in which the carriage stops and changes direction. It is important to obtain a treatment of said layer being as uniform as possible also in these turning zones, where the attack angle is often changed and the speed and the direction of movement of said carriage is also changed.

A device of the type defined in the introduction is already known by for instance EP 1 029 127 B1 of the applicant. The device described therein is provided with an arrangement ensuring that the mouth of the jet member nozzle is moving in a plane normally in parallel with the surface to be treated also when the jet member is pivoted in said turning zones.

This device and other known devices of this type has normally a determined attack angle of the jet upon the layer when the carriage is moving in said rectilinear path, and this attack angle is changed when reaching said turning zone by pivoting the jet member before the carriage has reached the end position and at the beginning of the movement back in the opposite direction for obtaining an attack angle of the same magnitude but with an opposite sign with respect to the perpendicular or another attack angle for the next run of the jet member. It is also possible that a vehicle on which the device is arranged is moved a step forward in connection with said turning before the next run is started.

It is known to change the speed of said carriage for compensating for said pivoting, so that the carriage is moving faster in said turning zone as long as the pivoting of the jet member is carried out. However, the jet member is in such devices already known pivoted with a constant angular speed in said turning zones resulting in a non-uniform treatment and an irregular treated surface in the turning zones.

It is pointed out that such pivoting of the jet member may take place anywhere along said rectilinear path of the carriage, but it is normally carried out in said turning zones.

SUMMARY OF THE INVENTION

The object of the present invention is to provide a device and a method of the type defined in the introduction reducing said problems described above of such devices already known.

This object is according to the invention obtained by designing the arrangement of said device to co-ordinate the control of said first and second drive means for moving said impact point of the jet with a substantially constant speed over said layer. By such a co-ordination of the control of the movement of the carriage and the pivoting movement of the jet member a uniform treatment of said layer may be obtained also during pivoting of said jet member, since it is ensured that the impact point will always move with a substantially constant speed over said layer.

It is pointed out that said jet member may also carry out an oscillation in the direction substantially perpendicular to said rectilinear path, but such oscillations is here deemed to be neglectable and they have not to be considered in the control for obtaining said substantially constant speed of said impact point of the jet over said layer.

According to a preferred embodiment of the invention said arrangement comprises a first member adapted to make measurements allowing establishment of the speed of the carriage substantially continuously during movement of the carriage, a second member adapted to make measurements allowing establishment of the contribution of a pivoting movement of said jet member to the speed of said impact point of the jet over said layer substantially continuously during pivoting of the jet member, means adapted to calculate the total speed of said impact point of the jet over said layer through information from said first and second members, and means adapted to compare the value of said total speed so calculated with a predetermined set speed value for determining a difference speed value, and the arrangement is adapted to control said drive means so as to cancel out said difference value. This means that it will be ensured that said substantially constant speed is always obtained, since the drive means are not simply controlled in a predetermined way for obtaining a predetermined set speed, but the instantaneous real speed is substantially continuously determined and compared with said set speed, and the control of the drive means is carried out so that these two speeds will coincide. This means that a compensation for changing operation properties of the drive means when the conditions are changed, such as different temperatures and pressures of hydraulic liquid when hydraulic drive means are used, automatically takes place. The reaction force experienced by the jet influencing the pivoting movement of the jet member will also be automatically compensated in this way. The same is valid for the influence of the gravitation upon the carriage and jet member when treating non-horizontal surfaces, such as vertical walls.

According to a preferred embodiment of the invention said first member is adapted to sense the instantaneous position of said carriage and deliver information thereabout to said calculating means. The speed of the carriage may in this way be reliably obtained by simple means.

According to another preferred embodiment of the invention said second member is adapted to sense the instantaneous angle made by the longitudinal direction of said jet member with respect to a predetermined direction thereof, such as the direction perpendicular to the layer to be treated, and send information thereabout to said calculating means. The contribution of a pivoting movement of said jet member to the speed of the impact point of the jet over the layer may reliably be determined by using such an angle sensor.

According to another preferred embodiment of the invention said calculating means is adapted to consider the distance between the pivot point of said jet member and the mouth of the nozzle thereof when calculating said contribution of said pivoting movement of said total speed of said impact point. This means that the results of said calculation may be kept very accurate also when said distance for any reason would change.

According to another preferred embodiment of the invention being a further development of the embodiment just mentioned said jet member is removably arranged on said base portion for being replaced by another jet member having a different distance between said pivot point and the mouth of the nozzle of the jet member, and said calculating means is adapted to consider such a changed distance when calculating the contribution of the pivoting of the jet member to the total speed of said impact point. This means that said constant predetermined set speed may be reliably obtained also when there is a desire to replace the jet member by a jet member having another length.

According to another preferred embodiment of the invention the device also comprises means for providing said calculating means with information about to which depth material has been removed from said layer by the jet of said jet member for considering this information when calculating the contribution of said pivoting movement to the total speed of said impact point when this impact point is to be moved over an area of the layer where material has already been removed to said depth. Such a removal to a certain depth substantially corresponds to a replacement of the jet member by a jet member being correspondingly longer than the previous one, and it will in this way be ensured that said total speed of said impact point will be substantially constant also in a possible second or third or . . . run of the jet member.

Said means for providing the calculating means with said depth information may be the same as the one used for making the calculating means to consider a changed length of the jet member, and it may be constituted by a keyboard or another set of buttons for feeding this data into said control arrangement by an operator.

According to another preferred embodiment of the invention said drive means are hydraulic motors, and said arrangement is adapted to control valves connected to said motors for controlling said speed of said impact point to be substantially constant.

According a still preferred embodiment of the present invention the device further comprises means adapted to guide the jet member to have the pivot axis thereof displaced with respect to said base portion during pivoting of the jet member with respect to said base portion so that the mount of the nozzle of the jet member describes a motion in substantially one and the same plane substantially perpendicular to the plane in which the jet member is pivoting. A combination of this property enabling a constant distance of the mouth of the nozzle to a layer to be treated by the jet irrespectively of the attack angle of the jet with said feature of the control arrangement to control the moving of said impact point of the jet with a substantially constant speed over said layer makes it possible to obtain an excellent result of the treatment of said layer.

The invention also comprises a method as well as embodiments thereof according to the description herein. The advantages thereof appear from the description above of the device according to the present invention.

The method according to the present invention is well suited to be carried out by a computer program making a computer or processor controlling the steps of said method, and the invention also comprises such a computer program.

Furthermore, the invention also comprises the use of a device according to the present invention for material removing treatment of a material layer, especially a concrete layer.

Further advantages as well as advantageous features of the invention appear from the following description.

BRIEF DESCRIPTION OF THE DRAWINGS

With reference to the appended drawings, below follows a specific description of a device and a method according to a preferred embodiment of the present invention.

In the drawings:

FIG. 2 is a schematic view of a jet member of a device according to the present invention, which is moving along a layer treated by the jet thereof and is viewed perpendicularly to a guide member, along which a carriage is movable, FIGS. 3 and 4 are more detailed views of the carriage with base portion of the device according to the present invention in different function positions, FIG. 5 is a very simplified view illustrating the way of function of a device according to a preferred embodiment of the present invention, and FIG. 6 is a simplified view similar to that according to FIG. 2 illustrating one aspect of the way of operation of the device according to the present invention.

DETAILED DESCRIPTION OF A PREFERRED EMBODIMENT OF THE INVENTION

Figure 1:
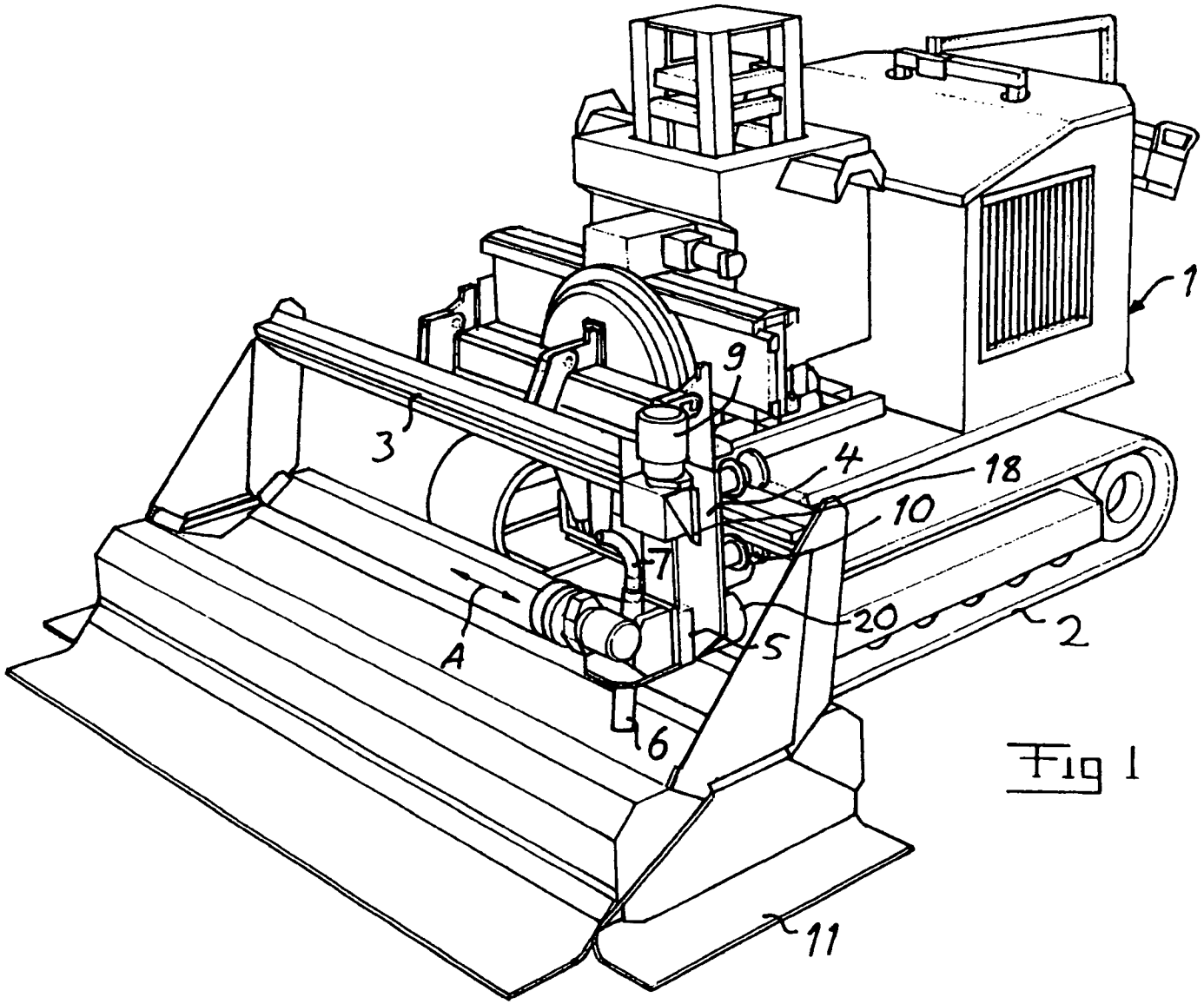
FIG. 1 is a schematic perspective view of a mobile unit, in which the device according to the invention is implemented.

The device according to the invention may, as illustrated in FIG. 1, be arranged on a mobile unit 1. This has the character of a vehicle movable on the bedding, for instance a concrete layer, to be treated. The vehicle is indicated as being of crawler type with two driving tracks 2.

On the vehicle 1 is arranged an elongated guide member 3 and a carriage 4 movable in a substantially rectilinear path to and fro along said guide member for carrying out so called traverses. A base portion 5 constitutes a part of the carriage 4. A tube-type jet member 6 or lance is arranged on the base portion 5 for directing a high pressure jet of liquid against the bedding. The guide member 3 in operation is intended to make an angle, preferably substantially a right angle, with a motion direction of the vehicle. The jet member 6 communicates through a conduit 7 with a source for delivering high pressure liquid, especially water, to the jet member. This high pressure source may be arranged on the vehicle 1 or on a separate carriage or the like.

The jet member 6 is arranged pivotably in relation to the base portion 5 about an axis 8 (see simplified FIG. 2) for changing the attack angle of said jet upon the layer to be treated. This axis 8, in the example, is extending substantially transversally to the length direction of the guide member 3, and more exactly substantially in right angle to a plane, in which plane the guide member 3 is located and which plane extends perpendicularly to the material layer to be treated.

A first drive means in the form of an hydraulic motor 9 is arranged for moving said carriage along the guide member 3 as indicated by the arrows A, whereas a second drive means in the form of an hydraulic motor 10 is arranged for pivoting the jet member 6 with respect to the base portion for changing the attack angle of the jet upon the layer to be treated. Such pivoting is substantially carried out in the turning zones close to the respective end position of the carriage 4 along said rectilinear path as will be described more in detail further below.

Means, such as rubber rollers 11 are arranged to bear on the bedding and restricting a space within which said treatment is carried out for protecting the surroundings of the vehicle 1 against material removed by the jet of the jet member 6 and thrown away. It is shown in FIG. 2 how the jet member 6 is moving to the left in a transversal movement while removing material, here concrete, from the bedding 12. The concrete layer is reinforced by a lattice-like grid of reinforcement bars 13, and by keeping the jet member 6 inclined the jet will reach under these reinforcement bars. The choice of the inclination direction of the jet member is due to the required treatment result and the character of the material. In the case shown in FIG. 2 the nozzle 14 of the jet member points in the motion direction of the carriage, and it will do so also when the carriage has changed moving direction.

A control arrangement adapted for controlling the drive means 9, 10, for example a suitable computer, is adapted, when the carriage 4 has reached a turning zone close to an end position along the guide member 3, to control the drive means 10 to pivot the jet member 6 so that its nozzle during the motion of the carriage in both directions of motion will be pointing in these motion directions. The end positions of the carriage 4 may be defined by sensor members connected to the control arrangement. The hydraulic motor 9 may be controlled to the move the carriage 4 one or several times, i.e. in one or more traverses, to a fro between said end positions before said driving tracks 2 are controlled to move the entire vehicle and by that the carriage 4 with the jet member 6 a step forwards, so called indexing, for treating a new area of the layer to be treated.

It is schematically illustrated in FIGS. 3 and 4 how guide means 15 are arranged to guide the jet member to have the pivot axis thereof displaced with respect to said base portion 5 of the carriage during pivoting of the jet member with respect to said base portion so that the mouth 16 of the nozzle of the jet member describes a motion in substantially one and the same plane 17 substantially perpendicular to the plane in which the jet member is pivoting. As seen, this plane 17, during operation is located directly above the layer 12 to be subjected to treatment. The construction of the guide means for obtaining this motion of said mouth 16 in the plane 17 may be the same as the one described in EP 1 029 127 B1 while making reference to FIGS. 8-10, and it will not be disclosed more in detail here. The jet member may also oscillate in a direction being transversal to the movement path of the carriage, but this oscillation has not to be considered when calculating the total speed of said impact point over said layer or when assuring that said mouth is moving in one and the same plane.

The function of the device according to the present invention will now be described while making reference also to FIGS. 5 and 6. The device comprises a first member 18 adapted to sense the instantaneous position of the carriage 4 and deliver information thereabout to a calculating means 19 as well as a second member 20 adapted to sense the instantaneous angle made by the longitudinal direction of the jet member 6 with respect to a predetermined direction thereof, such as the direction perpendicular to the layer to be treated, and send information thereabout to said calculating means 19. The calculating means 19 is adapted to calculate the total speed of the impact point of the jet over the layer to be treated through information from said first and second members. An arrangement 21 adapted to control the hydraulic motors 9, 10 include means adapted to compare the value of the total speed calculated by the calculating means with a predetermined set speed value for determining a difference value and to control the hydraulic motors 9, 10 by controlling hydraulic valves 22, 23 so as to cancel out said difference value, so that said impact point will move with a substantial constant speed over said layer. For being able to do this said control arrangement has to be aware of the distance between the pivot point of the jet member and the mouth of the nozzle thereof, which is known to the control arrangement when a basic jet member is moved over a portion of the layer not treated yet but otherwise has to be fed into the control unit 21 through a control terminal or the like by an operator. A new such distance value has to be fed into the control unit if the jet member is replaced by a jet member having a different length or the jet member is to be moved over a portion of the layer where material has already been removed to a certain depth as shown in FIG. 6. This depth D, which may for instance be about 50 mm, substantially corresponds to the change to a jet member having a length increasing by D with respect the jet member used in the first run or traverse.

It may in this way be ensured that the speed of the impact point I of the jet upon the layer to be treated is always constant and the same as a predetermined set speed. However, the carriage may very well be controlled to increase its speed in the turning zones rather much for making these turning zones shorter and by that the quality of the treatment at the turn points may be improved.

Said speed of the impact point may preferably be set to different values by using the same means as for feeding in a new jet member length and the like. It is also preferred to be able to change the width of the treated area in the same way by feeding in new values for the end positions of the travel of the carriage or for the width itself. Said width may typically be about 2000 mm. Also the attack angle of the jet for the traverse may be fed in in this way. It may typically be set within −45° and +45° with respect to a perpendicular to the layer to be treated. The control arrangement may also be provided with a number of "programs" that may be selected. One program may for instance mean one traverse with an attack angle of 0° and two traverses with an angle of 30° and −30°, respectively.

It is also shown in FIG. 5 how the driving tracks 2 are individually controlled by individual hydraulic motors 24, 25 by controlling hydraulic valves 26, 27 through said control arrangement 21 in accordance with signals delivered to said calculating means through sensors 28, 29 arranged at each driving track for ensuring that the vehicle 1 is moved along a rectilinear or other determined path when indexing.

The invention is of course not in any way restricted to the preferred embodiment described above, but may possibilities to modifications thereof would be apparent to a person with ordinary skill in the art without departing from the basic idea of the invention as defined in the appended claims.

Although the definition "impact point" is used above it is really not a question of a point, but a smaller restricted area on which the jet hits said layer.

The invention claimed is:

1. A method for moving a jet member (6) having a nozzle (14), comprising the steps of arranging said jet member (6) on a carriage (4) movable in a substantially rectilinear path and providing a base portion (5) to which said jet member (6) is pivotably connected, moving said carriage (4) and thereby the nozzle (14) of the jet member (6) in said rectilinear path over a layer to be treated by the jet and pivoting the jet member (6) with respect to said base portion (5) for changing the attack angle of the jet upon said layer, co-ordinating said movement in said rectilinear path and said pivoting for moving an impact point of the jet on said layer with a substantially constant speed over said layer, substantially continuously during movement of the carriage (4), carrying out measurements allowing establishment of the speed of the carriage (4), substantially continuously during pivoting of the jet member (6), carrying out measurements allowing establishment of the contribution of a pivoting movement of said jet member (6) to the speed of said impact point of the jet over said layer, calculating the total speed of said impact point of the jet over said layer through information about said two measurements, comparing the value of said total speed so calculated with a predetermined set speed value for determining a difference speed value, and controlling said movement in said rectilinear path and said pivoting movement to cancel out said difference value.

2. A method according to claim 1, wherein the measurements first mentioned are carried out by sensing the instantaneous position of said carriage (4), and information about this position is used for said calculation.

3. A method according to claim 1, wherein said measurements secondly mentioned are carried out by sensing the instantaneous angle made by the longitudinal direction of said jet member (6) with respect to a predetermined direction thereof, such as the direction perpendicular to the layer to be treated, and information about said angle is used in said calculation.

4. A method according to claim 1, wherein the distance between the pivot point (8) of said jet member (6) and the mouth (16) of the nozzle thereof is considered when calculating said contribution of said pivoting movement to said total speed of said impact point.

5. A method according to claim 4, wherein said jet member (6) being removably arranged on said base portion (5) for being replaced by another jet member having different distance between said pivot point and the mouth of the nozzle of the jet member, such a changed distance is considered when calculating the contribution of the pivoting of the jet member to the total speed of said impact point.

6. A method according to claim 1, wherein said movement in a rectilinear path and said pivoting movement are carried out by using hydraulic motors (9, 10), and valves (22, 23) connected to said motors are controlled for controlling said speed of said impact point to be substantially constant.

7. A method according to claim 1, wherein said jet member (6) is guided with respect to said base portion (5) during pivoting of the jet member with respect to said base portion so that the mouth (16) of the nozzle of the jet member describes a motion in substantially one and the same plane (17) substantially perpendicular to the plane in which the jet member is pivoting.

8. A device for moving a jet member (6) having a nozzle (14), said device comprising a carriage (4) movable in a substantially rectilinear path along a guide member (3) and provided with a base portion (5), said jet member (6) being pivotably connected to said base portion (5) on the carriage (4), first drive means (9) for moving said carriage (4) along said guide member (3) for moving the nozzle (14) of the jet member (6) in said rectilinear path over a layer to be treated by the jet, second drive means (10) for pivoting said jet member j) with respect to said base portion (5) for changing the attack angle of the jet upon said layer, and an arrangement (21) configured to control said first and second drive means (9, 10) and movement of the impact point of said jet on said layer, wherein said arrangement (21) is configured to co-ordinate the control of said first and second drive means (9, 10) for moving said impact point of the jet with a substantially constant speed over said layer, said arrangement (21) comprises a first member (18) positioned to make measurements allowing establishment of the speed of the carriage (4) substantially continuously during movement of the carriage (4), a second member (20) positioned to make measurements allowing establishment of the contribution of a pivoting movement of said jet member (6) to the speed of said impact point of the jet over said layer substantially continuously during pivoting of the jet member (6), means (19) for calculating the total speed of said impact point of the jet over said layer through information from said first and second members (18, 20), means for comparing the value of said total speed so calculated with a predetermined set speed value for determining a difference speed value, and the arrangement (21) is configured to control said drive means (9, 10) to cancel out said difference value.

9. A device according to claim 8, wherein said first member (18) is adapted to sense the instantaneous position of said carriage and deliver information thereabout to said calculating means (19).

10. A device according to claim 8, wherein said second member (20) is adapted to sense the instantaneous angle made by the longitudinal direction of said jet member (6) with respect to a predetermined direction thereof, such as the direction perpendicular to the layer to be treated, and send information thereabout to said calculating means (19).

11. A device according to claim 8, wherein said calculating means (19) is adapted to consider the distance between the pivot point (8) of said jet member (6) and the mouth (16) of the nozzle thereof when calculating said contribution of said pivoting movement to said total speed of said impact point.

12. A device according to claim 11, wherein said jet member (6) is removably arranged on said base portion (5) for being replaced by another jet member having a different distance between said pivot point (8) and the mouth (16) of the nozzle of the jet member, and said calculating means (19) is adapted to consider such a changed distance when calculating the contribution of the pivoting of the jet member to the total speed of said impact point.

13. A device according to claim 11, wherein it further comprises means for providing said calculating means (19) with information about to which depth (D) material has been removed from said layer by the jet of said jet member (6) for considering this information when calculating the contribution of said pivoting movement to the total speed of said impact point when this impact point is to be moved over an area of the layer where material has already been removed to said depth.

14. A device according to claim 8, wherein said drive means (9, 10) are hydraulic motors, and said arrangement (21) is adapted to control valves (22, 23) connected to said motors for controlling said speed of said impact point to be substantially constant.

15. A device according to claim 8, wherein it further comprises means (15) adapted to guide the jet member (6) with respect to said base portion (5) during pivoting of the jet member with respect to said base portion so that the mouth (16) of the nozzle of the jet member describes a motion in substantially one and the same plane (17) substantially perpendicular to the plane in which the jet member is pivoting.

16. A use of a device according to claim 8 for material removing treatment of a material layer, especially a concrete layer.

17. A computer program containing computer program code means for making a computer or processor controlling the steps of the method according to claim 1.

18. A device according to claim 9, wherein said second member (20) is adapted to sense the instantaneous angle made by the longitudinal direction of said jet member (6) with respect to a predetermined direction thereof, such as the direction perpendicular to the layer to be treated, and send information thereabout to said calculating means (19).

* * * * *